United States Patent [19]

Kornatowski

[11] 4,272,645

[45] Jun. 9, 1981

[54] ELASTOMERIC MOLDED STRAIN RELIEF

[75] Inventor: Boleslaw Kornatowski, Elizabeth, N.J.

[73] Assignee: The Singer Company, Stamford, Conn.

[21] Appl. No.: 116,510

[22] Filed: Jan. 29, 1980

[51] Int. Cl.[3] ..... H01R 13/58

[52] U.S. Cl. ..... 174/65 G; 174/135; 174/153 G; 339/103 B

[58] Field of Search ..... 174/65 G, 135, 153 G; 339/101, 102 R, 103 R, 103 B, 126 RS

[56] References Cited

U.S. PATENT DOCUMENTS

| | | | |
|---|---|---|---|
| 2,115,495 | 4/1938 | Mapelsden | 174/153 G X |
| 2,711,522 | 6/1955 | Goodwin | 339/126 RS X |
| 2,712,119 | 6/1955 | Strubel | 339/103 R |
| 2,862,996 | 12/1958 | Holmes | 339/103 B X |

*Primary Examiner*—Laramie E. Askin

*Attorney, Agent, or Firm*—Edward L. Bell; Robert E. Smith

[57] ABSTRACT

A molded, elastomeric strain relief 11 fits into an opening 36 in a housing 43 having an edge 37 and an edge of a wall portion 42 spaced apart by a distance less than the distance between outer edges of shoulders 17 and 18. A central portion 14 of the strain relief substantially fills the opening. An entrance end 13 with a beveled surface 27 on the same side as the shoulder 18 tapers toward the opposite side from which extends a projection 23 with a shoulder 24. The latter shoulder and the shoulder 17 grasp a barrier 56, one wall of which is the wall portion 42, and the shoulder 18 and another shoulder 28 grasp the opposite edge 37 of the opening to hold the strain relief firmly in place. Side recesses 31, 32 include shoulders against which pressure can be directed to deform the elastomeric material enough to get the shoulder 18 into the opening. Once sufficiently in, the strain relief pivots to engage the shoulder 24 behind the barrier 56.

8 Claims, 3 Drawing Figures

Fig. 1.
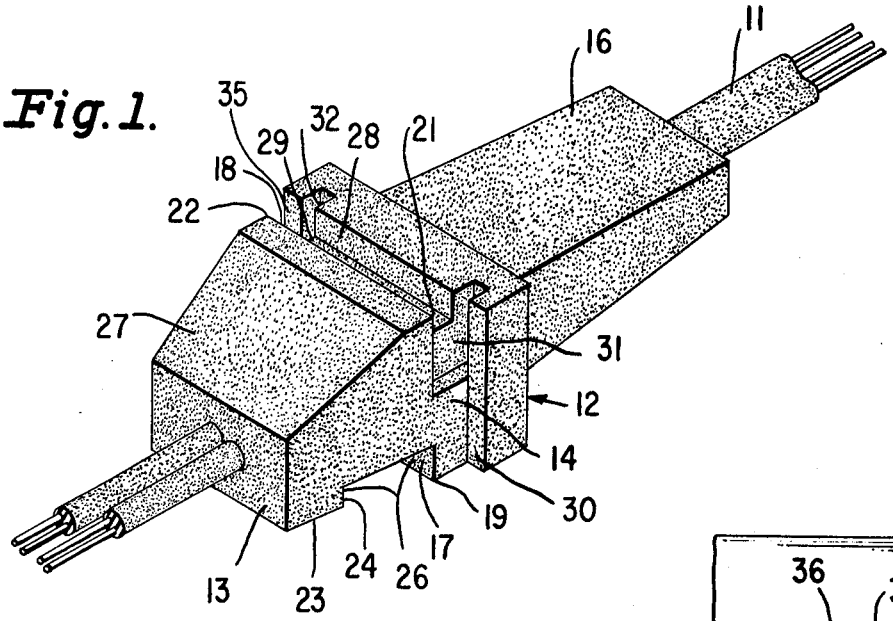
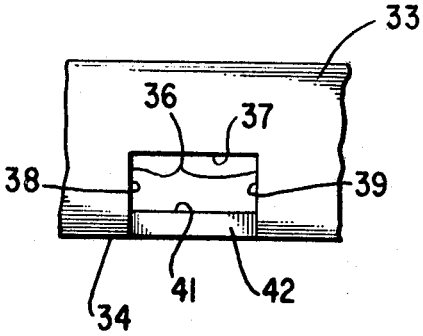
Fig. 2.
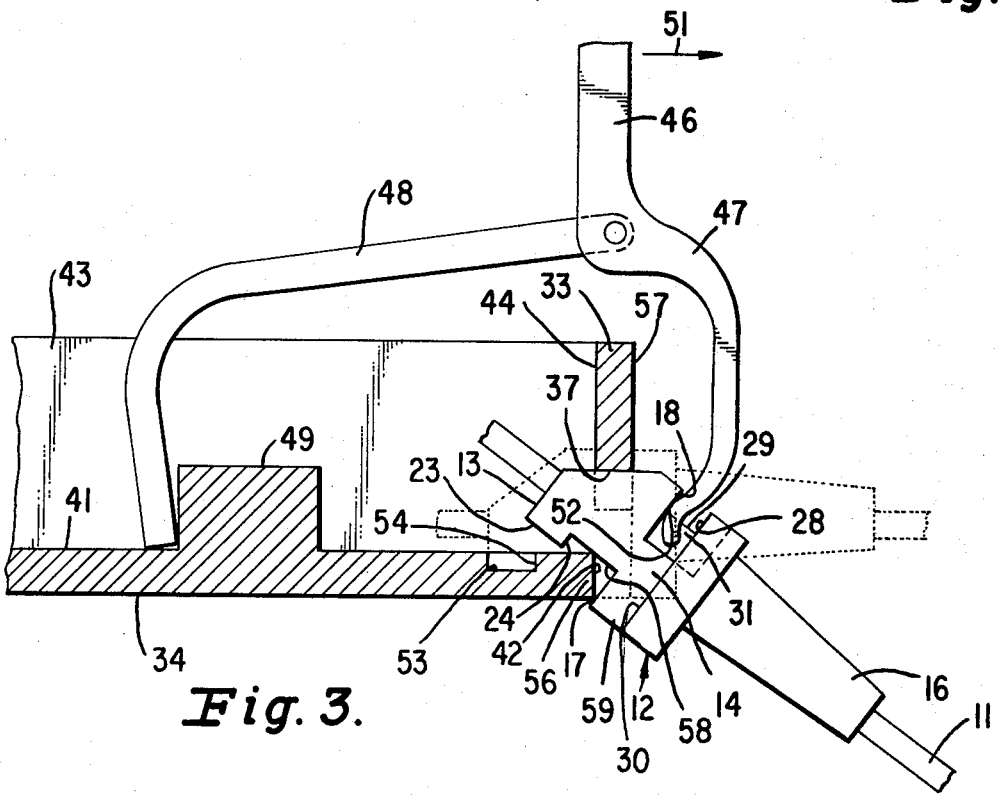
Fig. 3.

ELASTOMERIC MOLDED STRAIN RELIEF

BACKGROUND OF THE INVENTION

This invention relates to strain relief devices, and particularly to an elastomeric, molded strain relief shaped to simplify insertion into an opening in a housing of electrical equipment and to prevent the strain relief and the electric cord onto which it is molded from being easily withdrawn from the housing.

The use of strain relief devices to prevent electrical cords from being easily pulled out of electrical equipment is well known. Some strain relief devices have metal parts that are mechanically deformed, for example, by crimping them, to hold them firmly around an electrical cord. Other such devices are made of rigid plastic, shaped so as to grip the cord firmly when in place in an opening in the wall of a housing of electrical equipment.

It is also known to mold an enlarged elastomeric member at a specific place on an electric cord, the molded member being provided with flanges or shoulders or projections to engage the wall of the electrical device for which the electric cord serves as a means of connection to a wall socket. A device of the latter type is shown in U.S. Pat. No. 2,712,119. In order to hold it in place, it is inserted in a first plate that is attached to the wall on the unit, such as a vacuum cleaner, with which it is to be used. The wall of the unit has an additional opening with an edge so arranged as to fit into a slot in the elastomeric strain relief member when the latter, and the plate to which it is initially attached, are slid into place covering the opening in the wall of the electrical unit. The shape of the elastomeric strain relief member is such that it cannot be inserted into operative position after the remainder of the housing has been assembled, which is disadvantageous in many instances.

OBJECTS AND SUMMARY OF THE INVENTION

It is one of the objects of the present invention to provide an improved elastomeric molded strain relief member so shaped as to be relatively easy to press longitudinally into an opening in the wall of a housing of electrical equipment.

Another object is to provide an improved electrical structure, including a specific wall arrangement and an elastomeric strain relief member that fits into an opening in that wall arrangement relatively easily but is held firmly, once it has been inserted.

In accordance with the present invention, an elastomeric strain relief member is shaped so as to fit snugly into an opening in a wall of an electrical housing. The opening includes an edge having a predetermined thickness and an opposite edge defined by a barrier or second wall member. The elastomeric strain relief has a central portion so shaped as to fit into the opening and to be held therein. This portion, which is within the plane of the first wall portion when the elastomeric member is in position, has a configuration that substantially matches the perimeter of the opening so as to fill the opening. The forward end of the elastomeric member, that is, the end inserted into the opening, has a beveled surface that can be forced past the first edge in order to insert the elastomeric member into position.

On the opposite side of the elastomeric member from the beveled surface is a trough defined between two shoulders. The shoulder closer to the end of the elastomeric member inserted into the opening, which is called the entrance end, is one surface of a projection that extends down behind a flange, or barrier within the housing and helps to lock the elastomeric member in place, once it has been inserted. The opposite wall of the trough includes a shoulder that presses against an external surface, or outwardly facing wall portion of the housing, and helps prevent the elastomeric member from being inserted too far into the opening. Adjacent the beveled surface is another shoulder that extends from one end of the portion that lies within the opening when the elastomeric member is in position. This shoulder locks behind the portion of the wall that defines the first edge of the opening.

Still another shoulder on the elastomeric member is located at the other end of the portion that lies within the opening. The latter shoulder presses against the external part of the wall adjacent the edge of the opening and also helps hold the elastomeric member in position and prevents it from being inserted too far into the opening initially. Two side recesses are formed that extend along opposite sides of the elastomeric member from the side that faces the first-mentioned wall portion toward the side that includes the barrier. These recesses allow force to be applied against shoulders that define one surface of each of the recesses. This force presses the elastomeric member firmly into position after its entrance end has been inserted at an angle determined by the angle of the beveled surface and the space between that beveled surface and the trough on the opposite surface.

All of the shoulders, and the adjacent portions of the surfaces of the elastomeric member, are preferably straight in order to prevent any part of the elastomeric member from being pulled sufficiently to deform any part of the shoulders of the elastomeric member so as to wedge such part free of the edge of the opening and thereby start the removal of the elastomeric member from the opening. If the shapes of the shoulders allowed that much deformation, it would then be relatively easy to pull the strain relief completely out of the opening.

BRIEF DESCRIPTION OF THE DRAWINGS

FIG. 1 is a perspective view of a molded strain relief consisting of an elastomeric member formed in position on an electric cord;

FIG. 2 shows a fragment of a housing to illustrate an opening into which the strain relief in FIG. 1 is to be inserted;

FIG. 3 is a cross-sectional view of the electrical housing in FIG. 2 showing the strain relief of FIG. 1 being inserted into the opening in the housing.

DETAILED DESCRIPTION OF THE PREFERRED EMBODIMENT

FIG. 1 shows a typical 2-wire power cord 11 having rubber or other elastomeric insulation material molded on it. An elastomeric strain relief member 12 is molded in place on the power cord 11 and comprises, in order in the longitudinal direction along the strain relief, an entrance end 13, a central portion 14 that serves as a reference portion in describing various parts of the strain relief, and another end 16 that extends outwardly from the housing into which the strain relief 12 is normally inserted. The end 16 may, therefore, be referred to as the external end. The elastomeric material of which the strain relief 12 is formed may be a standard type with a durometer Shore A of about 70 to 85.

A first shoulder 17 extends transversely relative to the longitudinal direction of the strain relief from a first side thereof and a second shoulder 18 extends transversely in the opposite direction from the opposite side of the strain relief 12. In the embodiment in FIG. 1, the shoulders 17 and 18 are substantially coplanar, and both of the shoulders have flat surfaces and rectangular corners of which the corner 19 of the shoulder 17 is visible and both of the corners 21 and 22 of the shoulder 18 are visible.

A projection 23 extends downwardly from the same side of the strain relief 12 as does the shoulder 17 and includes a shoulder, or flange, 24 that is also flat and is spaced apart from, and parallel with, the surface of the shoulder 17. On the upwardly facing side of the strain relief 12, directly above the projection 23 and part of a trough 26 formed between the shoulders 17 and 24, is a beveled surface 27. The beveled surface starts at the entrance end 13 and slopes upwardly to the height of the shoulder 18 so that the extremity of the entrance end 13 is substantially smaller in cross section than is the central portion 14.

A third shoulder 28 extends outwardly from the central portion 14 and is spaced longitudinally along the strain relief 12 at a predetermined distance from the shoulder 18. The shoulder 28, like the other shoulders mentioned heretofore, has a substantially flat, rectangular surface, and its upper edge is at a predetermined distance above the flat surface 29 that forms the preferred shape of the upper surface of the central portion 14. The space defined by the shoulders 18 and 28 and the surface 29 is generally U-shaped ad may also be referred to as a trough. At the ends of the trough formed by these three surfaces are recesses 31 and 32 that have configurations such that they are mirror images of each other about an imaginary plane that defines the longitudinal center of the strain relief 12. Shoulders 30 and 35 extend outwardly from opposite sides of the strain relief in the same plane as the shoulder 28.

FIG. 2 shows a fragment of an electrical housing that includes a first wall 33 and a second wall 34. An opening in which the elastomeric strain relief 12 is to be inserted is identified by reference numeral 36 and is defined primarily within the wall 33 by an upper edge 37 and two side edges 38 and 39. The lower edge of the opening 36, as shown in FIG. 2, includes the part of the wall 34 that is also common to the wall 33 at the intersection of these two walls. Thus, the inner surface 41 of the wall appears within the opening 36, as does an end wall portion 42 of this part of the edge of the wall 34.

FIG. 3 shows a cross sectional view of both of the walls 33 and 34 at the opening 36 shown in FIG. 2. The elastomeric strain relief member 12 is shown in full lines in FIG. 3 in the position in which it is placed initially to be inserted into the opening 36. The entrance end 13 of reduced size is within the housing 43, the beveled surface 27 is wedged against the edge 37 of the opening 36 in the wall 33, and the shoulder 17 is against the edge 42 of the wall 34. In order to insert the elastomeric member farther into the opening 36, the body portion of the elastomeric member, principally the material forming the region adjacent the shoulder 18, must be compressed between the edges 37 and 42 sufficiently to allow the shoulder 18 to slide under the edge 37 and lock in place against the inner surface 44 that defines one of the surfaces of the wall 33 at the edge 37. Because of the beveled surface 27, it is not necessary to compress the projection 23, which can, therefore have a large enough cross section to be relatively inflexible. As a result, the projection is able to help hold the strain relief 12 securely in position after the strain relief has been inserted far enough into the opening 36 to be pivoted to the position in which it is locked in place, as shown in dotted lines.

One tool suitable to apply such pressure is a lever 46 that has two prongs of which only the prong 47 is visible in FIG. 3. This prong is inserted in the recess 31, and another prong directly behind the prong 47, is similarly inserted into the recess 32 (FIG. 1). A hook 48 is pivotally connected to the lever 46 and is formed so that it can hook behind a rigid member 49 that projects upwardly from the wall 34. By pulling the upper part of the lever 46 to the right as indicated by the arrow 51, the prong 47 and the other prong directly behind it will apply pressure at a point along a side portion 52 of the corner 21 facing the recess 31 and a corresponding side portion of the corner 22 facing the recess 32. Both of these shoulder portions are coplanar with the shoulder 18, and by pressing on them, force is applied below the upper edge of the shoulder 18 so as to allow such compression of the elstomeric material as is necessary to force it through the opening 36.

Other tools may be used to apply pressure to force the strain relief 12 into place, but it is preferable that, in any case, the pressure be applied at points displaced from the shoulder 18 toward the shoulder 17.

Once the elastomeric member has sufficiently penetrated the opening 36, the shoulder 18 can snap up in contact with the inner surface 44 of the wall 33 and the projection 23 can fit down into a recess 53 in the inner surface 41 of the wall 34. This recess has a shoulder, or flange, 54 the surface of which faces inwardly with respect to the housing 43 and is spaced from the edge 42 by a distance equal to or slightly greater than the distance between the shoulders 17 and 24. Thus, a barrier portion 56 that extends across the lower part of the opening 36 is gripped between the shoulders 17 and 24. The shoulders 24 and 18 prevent the elastomeric member 12 from being withdrawn from the opening 36, and the shoulders 17 and 28 prevent the elastomeric member 12 from being inserted too far.

The distance between the shoulders 18 and 28 is equal to the wall thickness of the wall 33 between the inner surface 44 and the outer surface 57. The distances between the inner and outer surfaces at the edge 37 is also the length of the central portion 14 that fills up the opening 36. In effect, the lower part of the central portion 14 that extends below the lower side 58 of the strain relief 12 forms a projection 59 that takes the place of the corner material common to both of the walls 33 and 34. The shoulders 30 and 35 close off the sides of the opening 36 (FIG. 2) by extending beyond the edges 38 and 39. This makes it impossible to insert a slender conductive member, such as a knife blade or a wire, between the central portion 14 of the member 12 and any of the edges 37–39 or the surface 41 that define the perimeter of the opening 36.

I claim:

1. A molded elastomeric strain relief to extend longitudinally through an opening in a wall of a housing, the wall having a predetermined thickness, the housing comprising a barrier extending across a first side of the opening and comprising an outwardly facing surface forming part of the periphery of the opening and an inwardly facing surface spaced from the outwardly facing surface by a predetermined first distance, the opening further being defined by an edge portion of the wall spaced from the outwardly facing surface by a second predetermined distance, the strain relief comprising:

an entrance end and an external end longitudinally spaced from the entrance end;

a central portion extending longitudinally along the strain relief between the entrance end and the exernal end and having a cross-section for substantially filling the opening;

a first shoulder extending transversely relative to the longitudinal direction of the strain relief at a location intermediate the ends and on a first side of the strain relief to abut against the outwardly facing surface to prevent the strain relief from being inserted too far into the opening;

a second shoulder at one end of the central portion and facing in the opposite direction from the first shoulder and extending transversely relative to a second side of the strain relief opposite the first side to engage the inner surface of the wall when the strain relief is fully inserted into the opening to prevent the strain relief from being easily removed from the opening;

a projection extending from the first side of the strain relief offset closer to the entrance end than the second shoulder is and spaced from the first shoulder towards the entrance end by a distance substantially equal to the first distance to form a trough in the strain relief between the projection and the first shoulder, whereby the outwardly facing surface and the inwardly facing surface on the barrier are clasped in the trough when the strain relief is in position in the opening;

a beveled surface on the second side of the strain relief extending from the height of the second shoulder toward the first side, whereby the portion of the strain relief adjacent the entrance end is tapered so that the extremity of the entrance end of the strain relief is smaller than the opening, to permit the tapered portion of the strain relief to be inserted at an angle into the opening, the distance between the bottom of the trough adjacent the first shoulder and the distal edge of the second shoulder being greater than the distance between the barrier and the edge portion of the wall;

a third shoulder extending substantially parallel to and in the same direction relative to the strain relief as the second shoulder and spaced from the second shoulder toward the external end of the strain relief to define the other end of the central portion, the cross-section of the central portion substantially conforming in shape to the shape of the opening; and side portions of the strain relief along third and fourth mutually opposite sides of the strain relief adjacent the second shoulder and facing away from the entrance end, whereby pressure can be applied to the side portions to force the tapered portion of the strain relief adjacent the second shoulder far enough into the opening to permit the second shoulder to engage the inner surface of the wall with the strain relief in position such that the projection locks behind the inwardly facing surface of the barrier and the second and third shoulders lock on opposite sides of a portion of the edge of the wall immediately adjacent the opening.

2. The elastomeric strain relief of claim 1 in which the second shoulder extends a predetermined height above the central portion and has a rectangular outline.

3. The elastomeric strain relief of claim 1 in which the surface of the central portion above which the second shoulder extends is a substantially level surface so that the height of the second shoulder is substantially uniform across the entire width of the central portion.

4. The elastomeric strain relief of claim 1 comprising side recesses in said third and fourth sides the side recesses exending below the level of the top of the central portion in the direction toward the first shoulder.

5. The elastomeric strain relief of claim 4 in which the second shoulder and the side portions are substantially coplanar, and the outwardly facing surface of the housing terminates in substantially the same plane as the inner surface of the wall.

6. The elastomeric strain relief of claim 4 in which the side recesses extend away from the tapered end a distance greater than the distance between the second and third shoulders.

7. The elastomeric strain relief of claim 6 in which said first and second shoulders and said side portions are substantially coplanar.

8. Electrical apparatus comprising a housing member having first and second walls of predetermined thicknesses substantially perpendicular to each other and intersecting at a corner;

an opening through the first wall and partly defined by edges therein adjacent the corner, the opening including a portion of the housing common to both of the walls, whereby the resulting exposed edge of the second wall extending across and defining one edge of the opening comprises a barrier;

a flange formed in the surface of the second wall interiorly of the housing and spaced from the exposed edge of the second wall by a first distance; and a molded elastomeric strain relief comprising:

an entrance end of smaller area than the opening, an external end spaced longitudinally from the entrance end, first and second oppositely directed sides, the first side facing the second wall, a central portion intermediate the two ends and having a cross-section substantially equal in size and shape to the opening including the portion of the housing common to both of the first and second walls at the corner, a trough formed in the first side of the strain relief, the trough being bounded by first and second shoulders extending transversely relative to the first side, the second shoulder extending a lesser distance from the first side than the first shoulder to engage behind the flange when the strain relief is in place in the opening to grip a portion of the second wall between the first and second shoulders, a third shoulder on the second side longitudinally offset from the second shoulder to be farther from the entrance end than the second shoulder is, whereby the third shoulder locks behind one edge of the opening in the first wall when the strain relief is in place in the opening, a fourth shoulder spaced from the third shoulder by a distance defining the length of the central portion and extending from the strain relief in the same direction as the third shoulder, the distance between the third and fourth shoulders being substantially equal to the thickness of the first wall, whereby the edge of the first wall that defines part of the opening is grasped between the third and fourth shoulders when the strain relief is in place in the opening, a beveled surface on the second side of the strain relief and forming a tapered end thereof tapering from at least approximately the level of the third shoulder towards the first side, whereby the tapered end can be inserted into the opening substantially unhindered until the first shoulder engages the edge of the second wall facing the opening, and side recesses on opposite sides of the strain relief adjacent the third shoulder to allow pressure to be placed on the strain relief at the recesses to force the strain relief fully into the opening, partly by compression of the third shoulder.

* * * * *